US006370988B1

(12) United States Patent
Thompson et al.

(10) Patent No.: US 6,370,988 B1
(45) **Date of Patent: *Apr. 16, 2002**

(54) RATCHETING SCREWDRIVER WITH REVERSING CAP HAVING PROJECTING PIN

(75) Inventors: Christopher D. Thompson, Milwaukee; Joseph R. Hoepfl, Greenfield, both of WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/692,711

(22) Filed: Aug. 6, 1996

Related U.S. Application Data

(63) Continuation of application No. 08/546,511, filed on Oct. 20, 1995, now Pat. No. 5,570,616, which is a continuation of application No. 08/388,993, filed on Feb. 15, 1995, now abandoned, which is a continuation of application No. 08/160,151, filed on Dec. 2, 1993, now Pat. No. 5,437,212.

(51) Int. Cl.[7] ..... B25B 13/46
(52) U.S. Cl. ..... 81/63.1; 192/43.2
(58) Field of Search ..... 81/60–63.2, 439; 192/43, 43.1, 43.2

(56) References Cited

U.S. PATENT DOCUMENTS

| | | | |
|---|---|---|---|
| 791,895 | A | 6/1905 | Furbish |
| 878,657 | A | 2/1908 | Munch |
| 1,008,164 | A | 11/1911 | Leopold |
| 1,388,836 | A | 8/1921 | Ripsch et al. |
| 1,388,923 | A | 8/1921 | Bullard |
| 1,878,053 | A | 9/1932 | Winger |
| 2,139,650 | A | 12/1938 | Anderson et al. |
| 2,193,984 | A | 3/1940 | Rhinevault |
| 2,201,827 | A | 5/1940 | Froeschl et al. |
| 2,292,228 | A | 8/1942 | Krieger |
| 2,294,510 | A | 9/1942 | Nakano |
| 2,627,330 | A | 2/1953 | Gantz |
| 2,744,432 | A | 5/1956 | Rueb |
| 2,897,932 | A | 8/1959 | Morgan |
| 3,061,061 | A | 10/1962 | Browning |
| 3,253,626 | A | 5/1966 | Stillwagon, Jr. et al. |
| 3,356,117 | A | 12/1967 | Wagner |
| 3,545,312 | A | 12/1970 | Angquist |
| 3,742,787 | A | 7/1973 | Whiteford |
| 3,783,703 | A | 1/1974 | Trimble et al. |
| 3,802,518 | A | 4/1974 | Albert |
| 3,824,881 | A | 7/1974 | Wright |
| 4,086,831 | A | 5/1978 | Smith |
| 4,235,269 | A | 11/1980 | Kraus |
| 4,290,328 | A | 9/1981 | Clark |

(List continued on next page.)

FOREIGN PATENT DOCUMENTS

| | | |
|---|---|---|
| DE | 9208547 | 3/1992 |
| DE | 9318291 | 3/1994 |
| GB | 584232 | 1/1947 |

*Primary Examiner*—D. S. Meislin
(74) *Attorney, Agent, or Firm*—Seyfarth Shaw

(57) ABSTRACT

A ratcheting driver handle has a ratchet body press-fitted axially in one end thereof, the body defining a socket which receives a gear for rotation coaxially with the handle. The socket also receives two pawls respectively disposed above and at opposite sides of the axis and spring-biased into engagement with the gear. A selector cap rotates on the housing and carries a first pin for driving the pawls respectively out of engagement with the gear, depending upon the direction of rotation, to control the ratchet direction. A second pin on the cap engages an over-center leaf spring mounted in the socket below the gear for resiliently retaining the mechanism in either of the forward or reverse conditions. A driver bit has a flattened end which is received through an axial bore in the cap and into a complementarily shaped bore through the gear for rotation therewith, being frictionally retained in place by a retaining ring.

11 Claims, 2 Drawing Sheets

U.S. PATENT DOCUMENTS

| | | | |
|---|---|---|---|
| 4,515,046 | A | 5/1985 | Johnson |
| 4,541,310 | A | 9/1985 | Lindenberger |
| 4,541,314 | A | 9/1985 | Korkowski |
| 4,546,677 | A | 10/1985 | Berkich |
| 4,703,676 | A | 11/1987 | Mayer |
| 4,735,120 | A | 4/1988 | Beugelsdyk |
| 4,777,852 | A | 10/1988 | Herman et al. |
| 4,793,222 | A | 12/1988 | Beugelsdyk |
| 4,799,407 | A | 1/1989 | Miyamoto |
| 4,916,988 | A | 4/1990 | Roberston et al. |
| D309,246 | S | 7/1990 | Cascio et al. |
| 5,063,797 | A | 11/1991 | Haung |
| 5,069,091 | A | 12/1991 | Bramsiepe et al. |
| 5,211,086 | A | 5/1993 | Shu |
| 5,329,834 | A | 7/1994 | Wong |
| 5,570,616 | A * | 11/1996 | Thompson et al |

* cited by examiner .

RATCHETING SCREWDRIVER WITH REVERSING CAP HAVING PROJECTING PIN

This application is a continuation of Ser. No. 08/546,511 Oct. 20, 1995 now U.S. Pat. No. 5,570,616 which is a continuation of 08/388,993 Feb. 15, 1995 ABN which is a continuation of 08/160,151 Dec. 2, 1993 U.S. Pat. No. 5,437,212.

BACKGROUND OF THE INVENTION

1. Field of the Invention

The present invention relates to driver handles for interchangeable driver bits and, in particular, to handles of the ratcheting type.

2. Description of the Prior Art

Ratcheting drivers have heretofore been provided, as have drivers with interchangeable bits. One type of ratcheting driver for interchangeable bits is disclosed in U.S. Pat. No. 4,777,852. That patent discloses a ratcheting arrangement wherein a ratchet body is press-fitted into a recess in one end of a handle and a cap telescopes over the body for rotation with respect thereto. A fairly complex linkage mechanism transmits force from the rotating cap to a pair of pawls for controlling engagement thereof with a ratchet gear, in which one end of a bit shank is coaxially received. The force transmission from the cap to the pawl assembly is indirect and involves a multi-part assembly.

SUMMARY OF THE INVENTION

It is a general object of the invention to provide an improved ratcheting driver handle which avoids the disadvantages of prior driver handles while affording additional structural and operating advantages.

An important feature of the invention is the provision of a ratcheting driver handle of the type set forth, which is of relatively simple and economical construction.

In connection with the foregoing feature, another feature of the invention is the provision of a handle of the type set forth which provides direct coupling between a selector and the pawl assembly of a ratcheting mechanism.

Another feature of the invention is the provision of a handle of the type set forth, which effectively retains the selector in either of selected forward or reverse positions, while at the same time effectively preventing overtravel of the selector.

Still another feature of the invention is the provision of an effective means for coupling an interchangeable bit with the driver handle.

These and other features of the invention are attained by providing a ratcheting driver handle for a driver bit having a shank, the handle comprising: an elongated body having an axis and an axial recess in one end thereof, ratchet mechanism disposed in the recess and including a gear and a pawl assembly engageable with the gear, the ratchet mechanism defining a bore for receiving the shank of the associated bit therein, the pawl assembly being movable between first and second conditions, the pawl assembly in its first condition engaging the gear so that the body rotates the gear therewith in one direction and ratchets with respect to the gear in the opposite direction, the pawl assembly in its second condition engaging the gear so that the body rotates the gear therewith in the opposite direction and ratchets with respect to the gear in the one direction, an annular selector member coupled to the one end of the body for rotation with respect thereto about the axis thereof between first and second positions respectively corresponding to the first and second conditions, an actuator carried by the selector member and engageable with the pawl assembly for movement thereof between the first and second conditions thereof in response to rotation of the selector member between the first and second positions thereof, and bias mechanism resiliently retaining the selector member in each of the first and second positions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2:
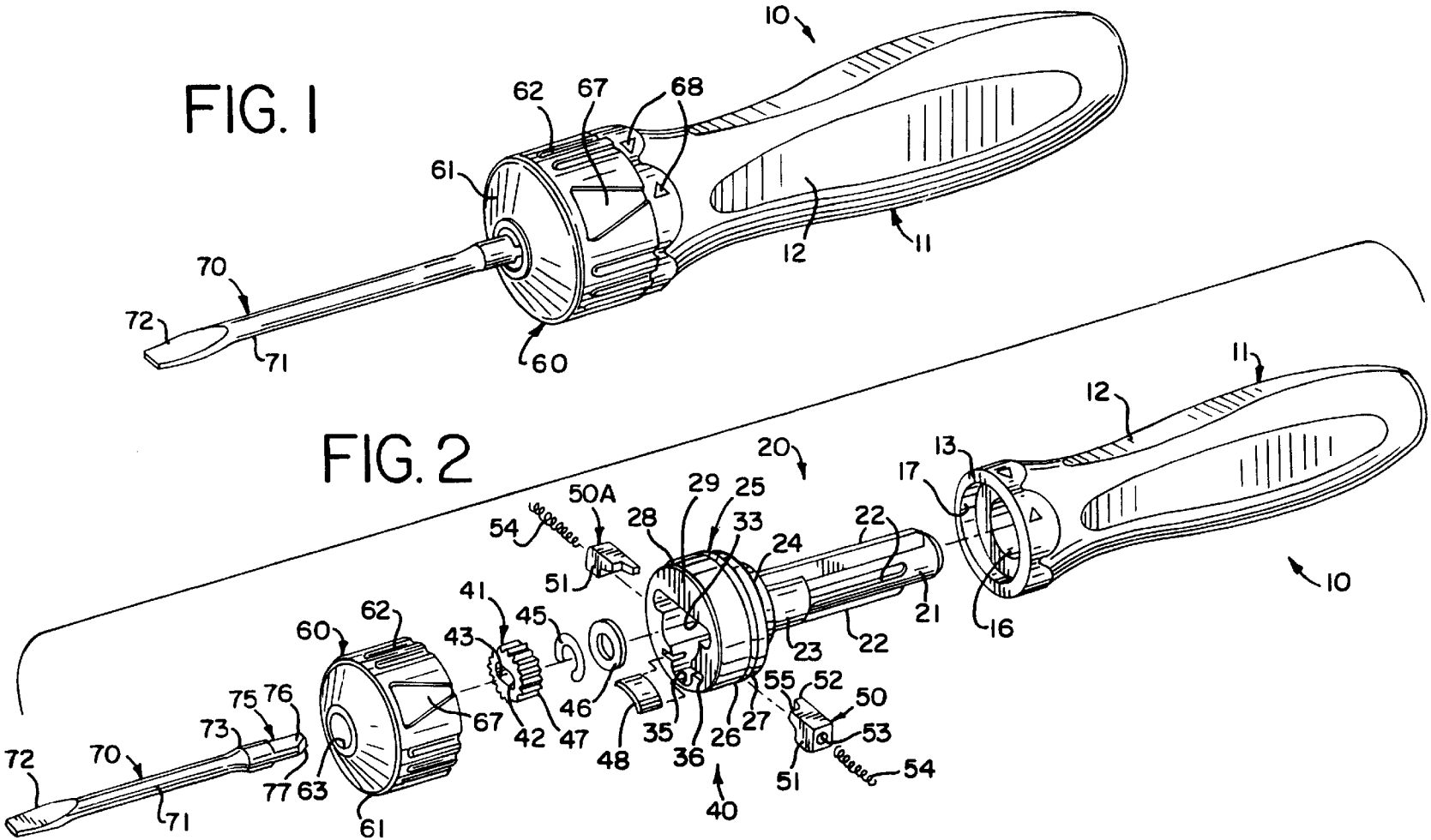
FIG. 1 is a perspective view of a ratcheting driver handle constructed in accordance with the present invention, with a screwdriver bit mounted therein.
FIG. 2 is a slightly reduced, exploded, perspective view of the handle/bit combination shown in FIG. 1.
Figure 3:
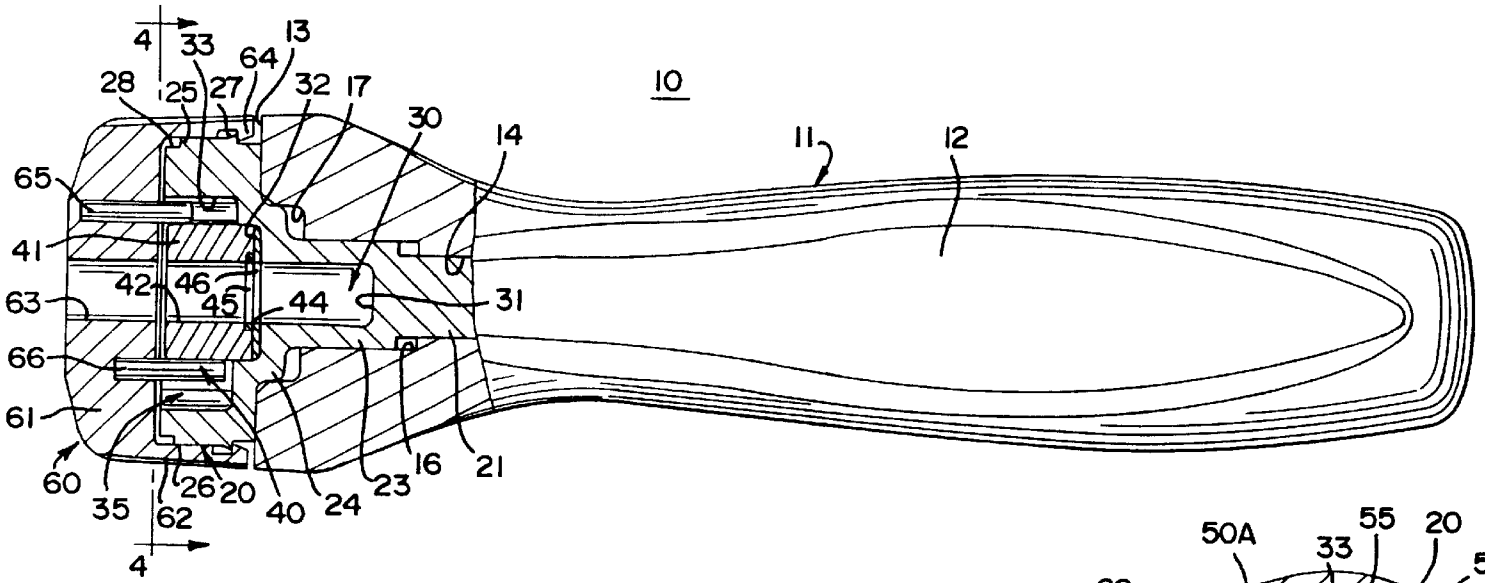
FIG. 3 is an enlarged, side elevational view of the handle of FIG. 1 in partial vertical section, illustrating the ratcheting mechanism.

Referring to FIGS. 1–3, there is illustrated a driver handle, generally designated by the numeral 10, which includes an elongated body 11 having an outer surface 12 sculpted to provide a good grip for the hand of the user. The body 11 has a flat, circular end wall 13 at one end thereof in which is formed an axial bore 14 (see FIG. 3) having successively increasing-diameter counterbores 16 and 17.

Figure 4:
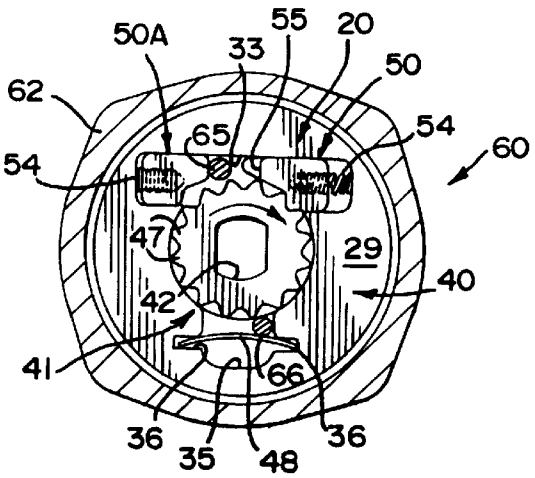
FIG. 4 is a view in vertical section taken along the line 4—4 in FIG. 3.

Referring in particular to FIGS. 2–4, the handle 10 is provided with a ratchet housing 20 having an elongated shank 21 adapted to be press-fitted in the bore 14. More specifically, the shank 21 is provided with a plurality of radially outwardly extending splines 22 to be received in the bore 14, effectively to prevent rotational movement of the housing 20 about the axis of the handle 10. The housing 20 has an enlarged-diameter portion 23 adapted to fit mateably in the counterbore 16 when the shank 21 is inserted in the bore 14. Adjacent to the enlarged-diameter portion 23 is a shoulder portion 24 having a still greater diameter, and adapted to fit in the counterbore 17. Unitary with the shoulder portion 24 is an enlarged-diameter cylindrical head 25, having a cylindrical outer surface 26 provided adjacent to the rear end thereof with a radially outwardly extending circumferential rib 27. In use, the shank 21 of the housing 20 is inserted in the bore 14 until the rear end of the head 25 abuts the end wall 13 of the body 11, as can best be seen in FIG. 3.

The head 25 has an end face 29, in which is formed a socket 30. The socket 30 includes a cylindrical bore 31 extending axially into the housing 20 and, specifically, well into the enlarged-diameter portion 23 thereof. The socket 30 has an enlarged-diameter cylindrical counterbore 32, which extends slightly into the shoulder portion 24, and upper and lower pockets 33 and 35 which communicate with the counterbore 32. The upper pocket 33 is substantially rectangular in shape and intersects the upper portion of the counterbore 32 and extends laterally outwardly therebeyond. The lower pocket 35 intersects the lower portion of the counterbore 32 and is provided with a pair of laterally outwardly extending slots 36.

A ratchet mechanism 40 is disposed in the socket 30. More specifically, the ratchet mechanism 40 includes a cylindrical gear 41 having an axial bore 42 therethrough, the bore 42 being oblong in transverse cross section, viz., essentially in the form of a cylindrical bore with truncated flat sides 43 defining chords of the cylinder. A cylindrical counterbore 44 is formed in the rear face of the gear 41 for receiving a split retaining ring 45, which has an inner diameter less than that of the bore 42. The gear 41 has teeth 47 around the outer surface thereof and is dimensioned to be seated in the counterbore 32 of the socket 30 for free rotational movement coaxially therewith. A thrust washer 46 may be disposed in the counterbore 32 behind the gear 41 for wear resistance. Preferably, the arcuate portion of the bore 42 has a diameter substantially equal to that of the bore 31 of the socket 30. An elongated, slightly arcuate leaf spring 48 has the opposite ends thereof respectively seated in the slots 36, with the spring 48 bowed upwardly, as can best be seen in FIG. 4.

The ratchet mechanism 40 also includes a pawl assembly including a pair of pawls 50 and 50A, respectively disposed in opposite ends of the upper pocket 33 of the socket 30, and formed as mirror images of each other. Each of the pawls 50 and 50A has a tooth 51 disposed for meshing engagement with the teeth 47 of the gear 41. Each also has a finger 52 having a recess 55 in the front side thereof, the fingers 52 being directed toward each other. The outer ends of the pawls 50 and 50A are provided with cylindrical bores 53, in which are respectively seated helical compression springs 54, which respectively bear against the adjacent ends of the upper pocket 33 resiliently to urge the pawls 50 and 50A into engagement with the gear 41, as can best be seen in FIG. 4.

In operation, when both of the pawls 50 and 50A are disposed in engagement with the gear 41, the gear 41 is locked against rotation relative to the handle 10. If the pawl 50A is pushed back out of engagement with the gear 41 against the urging of the associated spring 54, as illustrated in FIG. 4, so that only the pawl 50 engages the gear 41, then the gear 41 is adapted for ratcheting rotation in the direction of the arrow in FIG. 4 relative to the handle 10 and is locked against rotation in the opposite direction. It will be appreciated that the opposite is true if only the pawl 50A engages the gear 41.

The handle 10 also includes a selector cap 60 which is generally cup-shaped, including a generally circular end wall 61 integral around the periphery thereof with a cylindrical side wall 62. The end wall 61 has a cylindrical axial bore 63 extending therethrough which has substantially the same diameter as the bore 31 of the socket 30. Projecting laterally inwardly from the side wall 62 adjacent to the distal end thereof and around the entire circumference thereof is a retaining lip 64 (see FIG. 3). In use, the side wall 62 is dimensioned to be fitted telescopically over the head 25 of the ratchet housing 20 for free rotation relative thereto about the axis thereof, the retaining lip 64 snap-fitting over the circumferential rib 27 on the head 25 to prevent axial movement of the cap 60 once it has been installed in place.

Preferably, the cap 60 is formed of a suitable plastic material and has therein two pins 65 and 66 at diametrically opposed locations thereon, the pins 65 and 66 respectively projecting axially rearwardly of the end wall 61 predetermined distances, but substantially less than the axial extent of the side wall 62. The pins 65 and 66 are spaced apart a distance such that, when the cap 60 is installed in place, as illustrated in FIGS. 3 and 4, the pins 65 and 66 will both be disposed radially just outboard of the periphery of the gear 41. The pin 65 fits between the pawls 50 and 50A in the recesses 55 thereof, while the pin 66 is disposed in the lower pocket 35 of the socket 30 for engagement with the leaf spring 48. Preferably, the sidewall 62 of the cap 60 is provided on its outer surface with an indicium 67, to cooperate with corresponding indicia 68 on the handle 10 for indicating whether the selector cap 60 is in the forward or reverse position.

As can be seen from FIG. 4, in one of those positions, the pin 65 will hold the pawl 50A out of engagement with gear 41, while the pin 66 is seated against one side of the lower pocket 35, being resiliently urged to that position by the leaf spring 48. Thus, the gear 41 can ratchet in only one direction, which may be considered the forward direction. When the selector cap 60 is rotated clockwise, as viewed in FIGS. 1 and 4, from the position illustrated in FIG. 4 to the reverse position, the pin 65 will hold pawl 50 out of engagement with the gear 41. In order to move to this position, the pin 66 must overcome the bias of the leaf spring 48, flattening its bow sufficiently to move over center, this rotational movement of the cap 60 being stopped by engagement of the pin 66 with the other side of the lower pocket 35. Thus, it will be appreciated that the leaf spring 48 serves to resiliently retain the selector cap 60 in either of the forward or reverse positions in which it happens to be located and inhibits movement from that position, while the cooperation of the pin 66 with the sides of the lower pocket 35 effectively prevent overrotation of the selector cap 60.

Referring in particular to FIGS. 1 and 2, there is illustrated a driver bit 70 having an elongated cylindrical shank 71, provided at one end thereof with a blade 72 which, in the illustrated embodiment, is a slot-head screwdriver blade. The shank 71 is provided adjacent to the other end thereof with an enlarged-diameter portion 73, which terminates in a flat end 75 having parallel flat side surfaces 76 which lie along chords of the enlarged-diameter part 73. It will be appreciated that the enlarged-diameter portion 73 has a diameter slightly less than that of the bores 31 and 63 of the socket 30 and selector cap 60, respectively. Also, the flat end 75 is shaped and dimensioned for mateably being received in the bore 42 of the gear 41, cooperating therewith to prevent rotation of the bit 70 with respect to the gear 41. In this regard, the arcuate side edges of the flat end 75 are preferably chamfered, as at 77, to facilitate insertion in the bore 42 and through the retaining ring 45. It will be appreciated that the retaining ring 45 frictionally engages the arcuate portions of the flat end 75 for frictionally retaining the bit shank 71 in place in the handle 10. Accordingly, the bit 70 will rotate with the gear 41, in a known manner, the frictional retention of the bit 70 permitting removal of the bit 70 for interchange with other bits. It will also be appreciated that the shoulders formed between the flat end 75 and the enlarged-diameter portion 73 of the bit 70 engage the front surface of the gear 41 to limit the depth of insertion therein.

From the foregoing, it can be seen that there has been provided an improved ratcheting driver handle which is of simple and economical construction, affording a direct actuation of the ratchet mechanism pawls between forward and reverse directions, and yieldably be retaining the mechanism in each of the forward and reverse directions while effectively preventing overtravel of the direction selector. The handle also affords a simple and easy removable coupling to associated driver bits.

We claim:

1. A ratcheting driver handle for a driver having a shank, said handle comprising:

an elongated body having an axis and an axial recess in one end thereof, a ratchet mechanism disposed in said recess and including a gear and a pawl assembly including at least one pawl engageable with said gear, said ratchet mechanism having a bore for receiving therein the shank of the associated driver, said ratchet mechanism including mounting means for said pawl assembly accommodating movement of said at least one pawl between first and second conditions, said at least one pawl including a first tooth portion engaging said gear in the first condition of said pawl assembly so that said body rotates said gear with said body when the body is rotated in one direction and said body ratchets with respect to said gear when said body is rotated in the opposite direction, said pawl assembly including a second tooth portion engaging said gear in the second condition of said pawl assembly so that said body rotates said gear with said body when said body is rotated in said opposite direction and said body ratchets with respect to said gear when said body is rotated in said one direction, bias mechanism resiliently urging said tooth portions into engagement with said gear, a selector member coupled to said one end of said body and accessible by a user for manual movement with respect to said one end between first and second positions corresponding respectively to said first and second conditions of said pawl assembly, retaining mechanism resiliently retaining said selector member in each of its first and second positions, and actuator projection structure on said selector member extending parallel to said axis and positioned and dimensioned for direct engagement with said at least one pawl for movement of said at least one pawl between the first and second conditions in response to movement of said selector member between its first and second positions.

2. The driver handle of claim 1, wherein said projection structure includes a cylindrical pin.

3. The driver handle of claim 1, wherein said pawl assembly includes two pawls respectively engageable with said gear in said first and second conditions.

4. The driver handle of claim 3, wherein said projection structure includes portions respectively engageable with said pawls for respectively moving them out of engagement with said gear in said first and second conditions.

5. The driver handle of claim 3, wherein said projection structure includes a pin, the opposite sides of which are respectively engageable with said pawls.

6. The driver handle of claim 1, wherein said actuator projection structure is movable along an arcuate path coaxial with said axis.

7. The driver handle of claim 3, wherein said pawls are translationally movable between said first and second conditions.

8. The driver handle of claim 7, wherein said pawls are translationally movable along collinear aligned paths.

9. The driver handle of claim 1, wherein said retaining mechanism retains said selector member in only two stable positions.

10. The driver handle of claim 1, wherein said actuator projection structure has a transverse cross-sectional shape which has substantially the same extent in each of two orthogonal directions.

11. A ratcheting driver handle for a driver having a shank, said handle comprising:

an elongated body having an axis and an axial recess in one end thereof, a ratchet mechanism disposed in said recess and including a gear and a pawl assembly including first and second pawls engageable with said gear, said ratchet mechanism having a bore for receiving therein the shank of the associated driver, said ratchet mechanism including mounting means for said pawl assembly accommodating translational movement of said pawls along aligned collinear paths between first and second conditions of said pawl assembly, said first pawl engaging said gear in the first condition of said pawl assembly so that said body rotates said gear with said body when the body is rotated in one direction and said body ratchets with respect to said gear when said body is rotated in the opposite direction, said second pawl engaging said gear in the second condition of said pawl assembly so that said body rotates said gear with said body when said body is rotated in said opposite direction and said body ratchets with respect to said gear when said body is rotated in said one direction, a selector member coupled to said one end of said body and accessible by a user for manual movement with respect to said one end between first and second positions corresponding respectively to said first and second conditions of said pawl assembly, and actuator projection structure disposed on said selector member for movement along an arcuate path coaxial with said axis, said actuator projection structure extending parallel to said axis and positioned and dimensioned for direct engagement with said pawls for movement of said pawls between the first and second conditions of said pawl assembly in response to movement of said selector member between its first and second positions.

* * * * *